US008736541B2

(12) United States Patent
Du et al.

(10) Patent No.: US 8,736,541 B2
(45) Date of Patent: May 27, 2014

(54) REDUCING SCROLLING EFFECT FOR LCD LAMPS

(75) Inventors: Vincent Du, San Diego, CA (US); Marcelo Goto, San Diego, CA (US); Khoua Vang, Ramona, CA (US); Yoshiaki Shimizu, San Diego, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 1274 days.

(21) Appl. No.: 12/037,762

(22) Filed: Feb. 26, 2008

(65) Prior Publication Data

US 2009/0213098 A1 Aug. 27, 2009

(51) Int. Cl.
*G09G 3/36* (2006.01)

(52) U.S. Cl.
USPC ..... 345/102; 345/204; 315/294; 315/312; 315/208; 313/509

(58) Field of Classification Search
USPC ..... 345/102, 204; 315/294, 312, 209; 313/509
See application file for complete search history.

(56) References Cited

U.S. PATENT DOCUMENTS

| | | | | |
|---|---|---|---|---|
| 5,844,540 | A | 12/1998 | Terasaki | |
| 7,317,403 | B2 * | 1/2008 | Grootes et al. | 340/815.45 |
| 7,477,228 | B2 * | 1/2009 | Wyatt | 345/102 |
| 7,737,937 | B2 * | 6/2010 | Fisekovic et al. | 345/102 |
| 2005/0134547 | A1 * | 6/2005 | Wyatt | 345/102 |
| 2008/0018985 | A1 * | 1/2008 | Whitehead et al. | 359/298 |

FOREIGN PATENT DOCUMENTS

| | | | |
|---|---|---|---|
| JP | 1-136127 | A2 | 5/1989 |
| JP | 2006-47925 | A2 | 2/2006 |
| WO | WO 2006/095743 | A1 | 9/2006 |

OTHER PUBLICATIONS

*LCD Backlighting*, Pacific Display Services, http://www.pacificdisplay.com/lcd_backlights.htm, 2007.
*Design Challenges for Backlighting LCD TVs*, MAXIM, APP 3513, Apr. 29, 2005, http://www.maxim-ic.com/appnotes.cfm/an_pk/3513.
*Power Supply IC for LCD Panels*, Science Links Japan, vol. 48, No. 1, pp. 12-14, (2002), http://www.sciencelinks.jp/j-east/article/200212/000020021202A0346966.php.
*PWM Sets Output of LCD/LED Driver*, MAXIM, AN 3326, Aug. 27, 2004, http://www.maxim-ic.com/an3326.

* cited by examiner

*Primary Examiner* — Grant Sitta
(74) *Attorney, Agent, or Firm* — Fitch, Even, Tabin & Flannery LLP

(57) ABSTRACT

A liquid crystal display (LCD) device's microcontroller is used drive an LCD lamp ballast such that the scrolling effect from its light leakage may be reduced to a visually imperceptible level. A check may be performed of lamp's control status in order to verify the microcontroller's ability to properly and accurately control the lamp ballast. The microcontroller may then determine a frequency and duty cycle to use for the microcontroller's PWM control signal. Thereafter, the microcontroller may generate the PWM control signal in accordance with the determined frequency and duty cycle, and drive the lamp ballast using the control signal.

22 Claims, 3 Drawing Sheets

REDUCING SCROLLING EFFECT FOR LCD LAMPS

FIELD OF THE INVENTION

The present invention relates generally to compensating or reducing noise effects, and more particularly to reducing scrolling effects caused by light leakage from liquid crystal display (LCD) lamps.

BACKGROUND OF THE INVENTION

LCD lamps are susceptible to light leakage that manifests as a visible scrolling effect on the display screen. This is particular an issue for rear projection LCD televisions, but can be found in other types of LCD devices. It is generally known that when the lamp frequency is near a constant multiple of the video update rate, this scrolling effect can be seen. In order to counter this effect, prior art systems have utilized various additional hardware components, such as a pulse width modulated (PWM) dimmer driving circuit. However, such solutions tend to increase the cost and complexity of the LCD display devices. Such solutions are also not readily upgradeable, nor are they modifiable. Accordingly, there is a need in the art for an improved method of reducing scrolling effects caused by light leakage from LCD lamps.

SUMMARY OF THE INVENTION

Disclosed and claimed herein are liquid crystal display (LCD) devices and methods for reducing light leakage from an LCD lamp ballast. In one embodiment, an LCD device includes an LCD lamp ballast and a microcontroller coupled to the LCD lamp ballast. The microcontroller may be configured to check a control status of the LCD lamp ballast, determine a pulse width modulation (PWM) frequency and duty cycle, and generate a PWM control signal based on the PWM frequency and duty cycle. The microcontroller may be further configured to then drive the lamp ballast using the PWM control signal.

Other aspects, features, and techniques of the invention will be apparent to one skilled in the relevant art in view of the following description of the exemplary embodiments of the invention.

DETAILED DESCRIPTION OF THE EXEMPLARY EMBODIMENTS

Overview of the Disclosure

Figure 1:
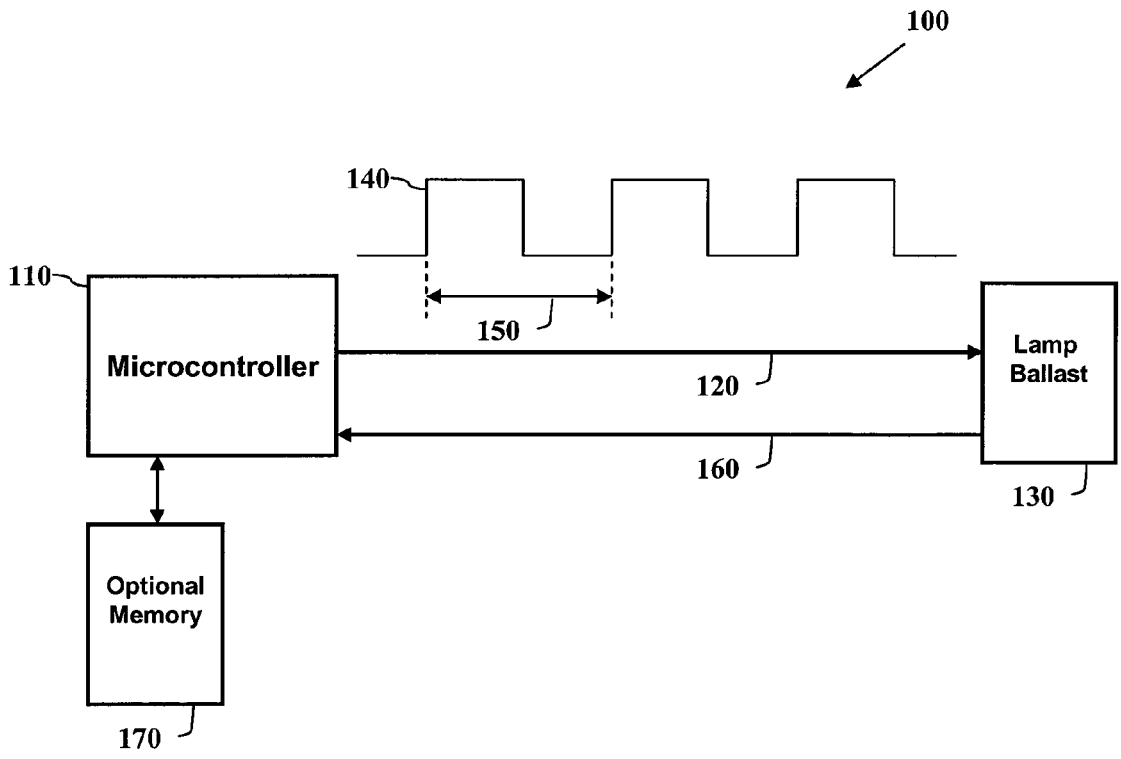
FIG. 1 is one embodiment of a system configured in accordance with the principles of the invention.

One aspect of the invention relates to using an LCD display device's microcontroller to drive an LCD lamp such that the scrolling effect from its light leakage may be reduced to a visually imperceptible level. In one embodiment, a check may be performed of lamp's control status in order to verify the microcontroller's ability to properly and accurately control the lamp ballast. The microcontroller may then determine a frequency and duty cycle to use for the microcontroller's PWM control signal. Thereafter, the microcontroller may generate the PWM control signal in accordance with the determined frequency and duty cycle, and drive the lamp ballast using the control signal.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive. Reference throughout this document to "one embodiment", "certain embodiments", "an embodiment" or similar term means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner on one or more embodiments without limitation.

In accordance with the practices of persons skilled in the art of computer programming, the invention is described below with reference to operations that are performed by a computer system or a like electronic system. Such operations are sometimes referred to as being computer-executed. It will be appreciated that operations that are symbolically represented include the manipulation by a processor, such as a central processing unit, of electrical signals representing data bits and the maintenance of data bits at memory locations, such as in system memory, as well as other processing of signals. The memory locations where data bits are maintained are physical locations that have particular electrical, magnetic, optical, or organic properties corresponding to the data bits.

When implemented in software, the elements of the invention are essentially the code segments to perform the necessary tasks. The code segments can be stored in a processor readable medium, which may include any medium that can store or transfer information. Examples of the processor readable mediums include an electronic circuit, a semiconductor memory device, a read-only memory (ROM), a flash memory or other non-volatile memory, a floppy diskette, a CD-ROM, an optical disk, a hard disk, a fiber optic medium, a radio frequency (RF) link, etc.

Overview of an Exemplary Embodiment

FIG. 1 depicts a system 100 that includes an LCD display device's microcontroller 110 providing an output control signal 120 for driving a lamp ballast 130 of the LCD device. In one embodiment, the lamp ballast 130 corresponds to the lamp ballast of an LCD rear projection television. In another embodiment, the lamp ballast 130 may correspond to any LCD device which experiences light leakage manifesting as a visible scrolling effect.

The output control signal 120 may be a PWM signal with a modulation pattern 140 having a frequency 150. In one embodiment, the frequency 150 may be approximately 170 Hz (±5 Hz), in other embodiments the frequency 150 may be between 50 Hz and 250 Hz.

Moreover, while in the embodiment of FIG. 1 the duty cycle of the modulation pattern 140 is approximately 50%

(±5%), it should equally be appreciated that the duty cycle may be between 10% and 90%.

As shown in FIG. 1, the microcontroller 110 may provide a control signal 120 for driving the lamp ballast 130 such that the timing of the inherent light leakage from the lamp ballast 130 is altered enough to reduce the scrolling effect caused by the light leakage to a visually imperceptible level.

The embodiment of FIG. 1 further depicts the lamp ballast 130 as being capable of providing status information to the microcontroller 110 using status signal 160. Microcontroller 110 is further coupled to an optional memory 170, which may be used to store values representative of the modulation pattern 140, such as the frequency 150 and/or duty cycle. Similarly, it should be appreciated that optional memory 170 may be integrated with the microcontroller 110, as is generally known in the art of microcontroller design.

It should be appreciated that the microcontroller 110 of FIG. 1 may be any type of computer processing unit, such as a microprocessor, digital signal processor, reduced instruction set computer (RISC), application specific integrated circuit and the like. Similarly, although shown as a single processing unit, it should further be appreciated that the microcontroller may alternatively include multiple processing units.

Figure 2:
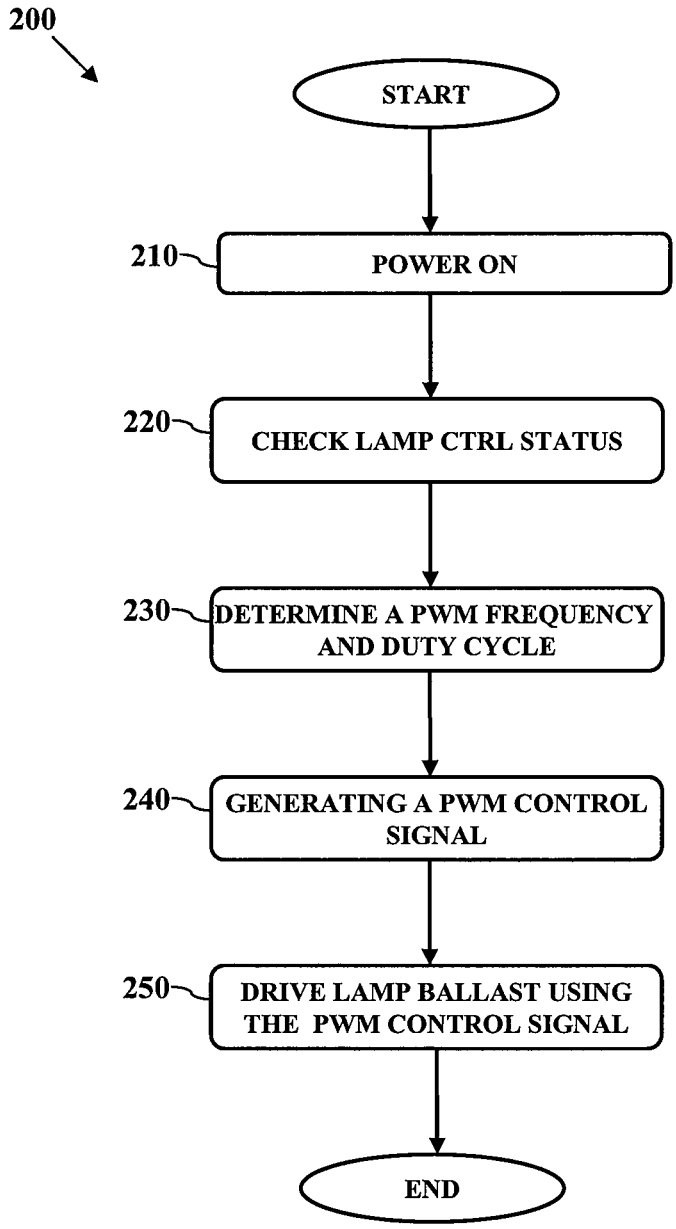
FIG. 2 illustrate a process for carrying our one or more embodiments of the invention.

With reference now to FIG. 2, depicted is in one embodiment of a process 200 for using an LCD display device's microcontroller (e.g., microcontroller 110) to drive a LCD lamp ballast (e.g., lamp ballast 130) such that the scrolling effect from its light leakage may be reduced to a visually imperceptible level. Process 200 begins with the LCD device being powered on at block 210. Process 200 may then continue to block 220 where a check of the lamp's control status may be performed. In one embodiment, the operation of block 220 may be performed in order to verify the microcontroller's ability to properly and accurately control the lamp ballast. One embodiment of a process for performing the checking operation of block 220 is set forth in more detail below with reference to FIG. 3.

Following a successful check of the lamp's control status, process 200 may continue to block 230 where the frequency (e.g., frequency 150) and duty cycle of the microcontroller's PWM control signal may be determined. In one embodiment, the frequency and duty cycle may be determined by the microcontroller by accessing a memory containing values representative of the frequency and/or duty cycle. While in one embodiment, the frequency may be approximately 170 Hz (±5 Hz), in other embodiments the frequency may be between 50 Hz and 250 Hz. Moreover, the duty cycle of the PWN control signal may be approximately 50% (±5%), it should equally be appreciated that the duty cycle may be between 10% and 90%, in accordance with the principles of the invention.

Continuing to refer to block 230 of FIG. 2, it should be appreciated that the frequency and/or the duty cycle of the microcontroller's PWM control signal may be based, at least in part, on system frequency requirements.

Process 200 may then continue to block 240 where the microcontroller may generate a PWM control signal having a frequency and duty cycle as determined above at block 230.

Thereafter, at block 250 the microcontroller may transmit or otherwise provide the control signal to the lamp ballast such that the device's lamp is driven using the PWM control signal. In one embodiment, the lamp ballast may be driven using the LCD device's own microcontroller such that the timing of the light leakage from the lamp ballast is altered enough to reduce the scrolling effect to a visually imperceptible level.

Figure 3:
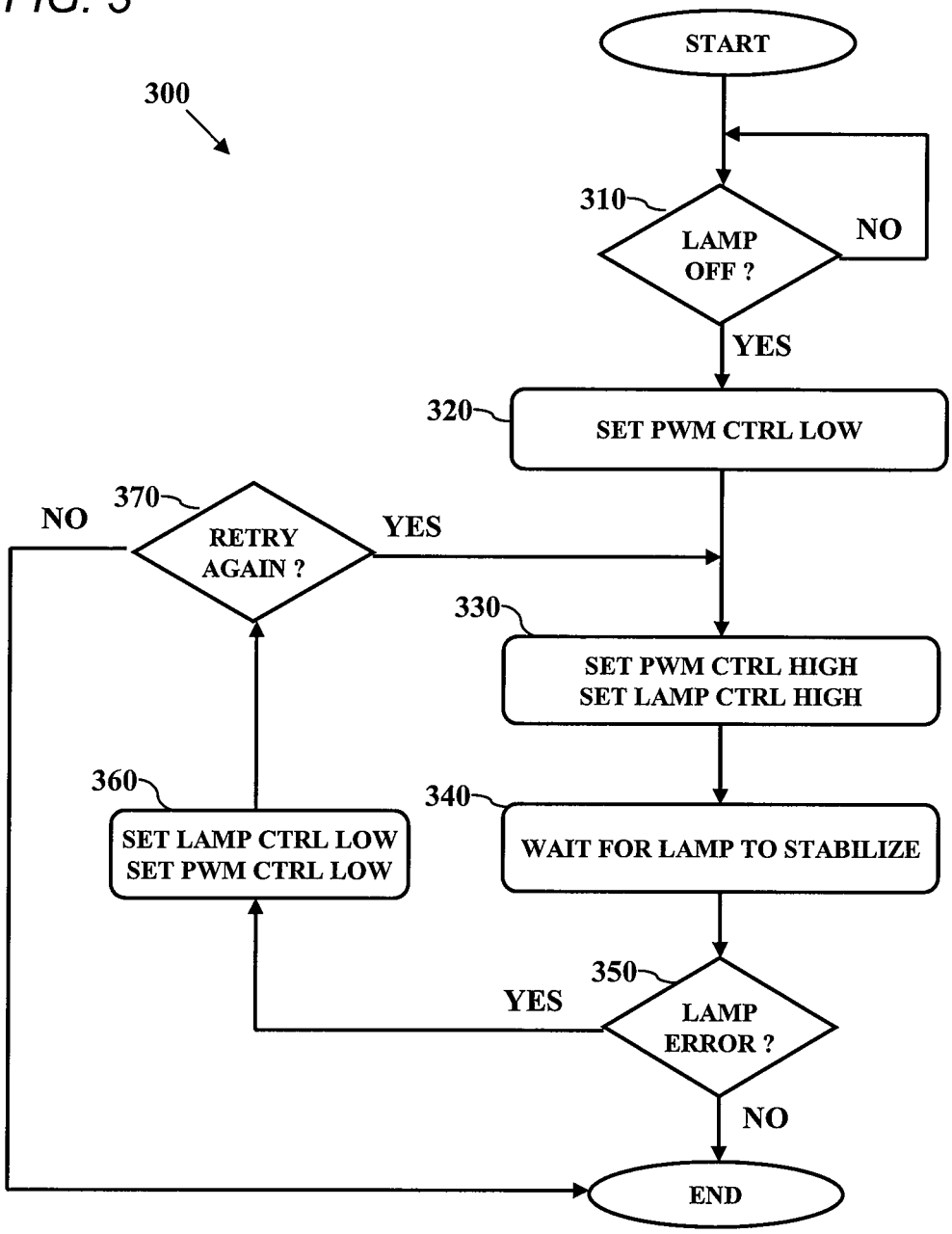
FIG. 3 illustrate a process for carrying out a lamp control status check in accordance with one embodiment of the invention.

With reference now to FIG. 3, depicted is in one embodiment of a process 300 for checking an LCD display device's lamp control status, in accordance with the operation described above with reference to block 220 of FIG. 2. In particular, process 300 may begin at block 310 where a determination may be made as to whether the LCD device's lamp (e.g., lamp ballast 130) is off. Once it is determined that the device's lamp is in fact off, process 300 may continue to block 320 where a microcontroller (e.g., microcontroller 110) PWM control signal may be initialized to a low state such that it is synchronized with the current lamp state.

Thereafter, process 300 may continue to block 330 where both the PWM control signal and the lamp's duty cycle may be set to a high state. In one embodiment, setting the lamp ballast's duty cycle to high may correspond to turning on the lamp ballast in accordance with the PWM control signal.

Process 300 may then continue to block 340 where the process may then wait until the lamp stabilizes. In one embodiment, this period of time may be predetermined and based on known stabilization values for the given lamp. Once the predetermined stabilization period has passed, process 300 may continue to block 350 where a determination may be made as to whether there is a lamp error. In one embodiment, a lamp error may be detected by the microcontroller based on an error signal provided by the lamp to the microcontroller (e.g., signal 160). In another embodiment, a lamp error may be detected where the lamp fails to turn on in response to setting the lamp's duty cycle to the high state.

In the event that no error is reported by the lamp at block 350, process 300 may end with a successful lamp control check having been performed. If, on the other hand, an error is reported at block 350, then process 300 will continue to block 360 where both the PWM control signal and the lamp's duty cycle may be set to a low state. In one embodiment, setting the lamp ballast's duty cycle to low may correspond to turning off the lamp ballast in accordance with the PWM control signal. A determination may then be made at block 370 as to whether another attempt to perform a lamp control should be performed. In one embodiment, a predetermined number of tries (e.g., 3 tries) may be attempted before process 300 will abort. In one embodiment, the lamp ballast being checked may include a register setting indicating that it may be controlled by a microcontroller in accordance with the principles of the invention. To that end, an optional register check may be performed by the microcontroller.

If it is determined at block 370 that another attempt should be made, process 300 may loop back through block 330-350 until either no error is detected at block 350 or the maximum number of attempts is reach at block 370. In this fashion, an LCD display device's lamp control status may be verified prior to attempting to drive the lamp ballast using a microcontroller's PWM control signal as described above with reference to block 240 of FIG. 2.

While the invention has been described in connection with various embodiments, it should be understood that the invention is capable of further modifications. This application is intended to cover any variations, uses or adaptation of the invention following, in general, the principles of the invention, and including such departures from the present disclosure as come within the known and customary practice within the art to which the invention pertains.

What is claimed is:

1. A liquid crystal display (LCD) device comprising:

a liquid crystal display (LCD) lamp ballast; and a microcontroller coupled to the LCD lamp ballast, the microcontroller configured to:

check a control status of the LCD lamp ballast by testing a responsiveness of the lamp ballast to a test control signal and responsively retriggering the lamp ballast up to a predetermined number of times if a lamp error occurs;

determine a pulse width modulation (PWM) frequency and duty cycle; generate a PWM control signal based on the PWM frequency and duty cycle; and drive the lamp ballast in accordance with the PWM control signal;

wherein the LCD lamp ballast is configured to provide status information to the microcontroller.

2. The LCD device of claim 1, wherein the microcontroller is further configured to drive the lamp ballast in accordance with the PWM control signal such that a scrolling effect caused by a light leakage is reduced to a visually imperceptible level.

3. The LCD device of claim 1, wherein the PWM frequency is between 50 Hz and 250 Hz.

4. The LCD device of claim 3, wherein the PWM frequency is approximately 170 Hz.

5. The LCD device of claim 1, wherein the microcontroller is further configured to determine the lamp error has occurred by at least one of receiving an error signal provided by the lamp and detecting that the lamp failed to activate.

6. The LCD device of claim 1, further comprising a memory that is accessible to the microcontroller, and wherein the microcontroller is further configured to determine the PWM frequency and duty cycle by reading values representative of the PWM frequency and duty cycle from the memory.

7. The LCD device of claim 1, wherein the LCD device comprises a rear projection television.

8. A method for reducing light leakage from a liquid crystal display (LCD) lamp ballast of a display device comprising the acts of:

checking a control status of the LCD lamp ballast by testing a responsiveness of the lamp ballast to a test control signal and responsively retriggering the lamp ballast up to a predetermined number of times if a lamp error occurs;

determining a pulse width modulation (PWM) frequency and duty cycle;

generating a PWM control signal by a microcontroller of the display device based on the PWM frequency and duty cycle; and driving the lamp ballast in accordance with the PWM control signal;

wherein the LCD lamp ballast is configured to provide status information to the microcontroller.

9. The method of claim 8, wherein driving the lamp ballast further comprises driving the lamp ballast in accordance with the PWM control signal such that a scrolling effect caused by the light leakage is reduced to a visually imperceptible level.

10. The method of claim 8, wherein the PWM frequency is between 50 Hz and 250 Hz.

11. The method of claim 10, wherein the PWM frequency is approximately 170 Hz.

12. The method of claim 8, wherein the driving the lamp ballast in accordance with the PWM control signal comprises transmitting the PWM control signal by the microcontroller to the lamp ballast.

13. The method of claim 8, wherein the testing determines the lamp error has occurred by at least one of receiving an error signal provided by the lamp and detecting that the lamp failed to activate.

14. The method of claim 8, wherein the determining the PWM frequency and duty cycle comprises reading values representative of the PWM frequency and duty cycle from a memory accessible to the microcontroller.

15. The method of claim 8, wherein the display device comprises a rear projection television.

16. A computer program product comprising a non-transitory computer readable medium having computer executable program code instructions that when executed by a computer cause the computer to reduce light leakage from a liquid crystal display (LCD) lamp ballast of a display device, the computer readable medium having:

computer executable program code to check a control status of the LCD lamp ballast testing a responsiveness of the lamp ballast to a test control signal and responsively retriggering the lamp ballast up to a predetermined number of times if a lamp error occurs;

computer executable program code to determine a pulse width modulation (PWM) frequency and duty cycle;

computer executable program code to generate a PWM control signal by a microcontroller of the display device based on the PWM frequency and duty cycle;

computer executable program code to drive the lamp ballast in accordance with the PWM control signal; and computer executable program code to receive status information from the LCD lamp ballast.

17. The computer program product of claim 16, wherein the computer executable program code to drive the lamp ballast comprises computer executable program code to drive the lamp ballast in accordance with the PWM control signal such that a scrolling effect caused by the light leakage is reduced to a visually imperceptible level.

18. The computer program product of claim 16, wherein the PWM frequency is between 50 Hz and 250 Hz.

19. The computer program product of claim 18, wherein the PWM frequency is approximately 170 Hz.

20. The computer program product of claim 16, wherein the computer executable program code to test a responsiveness of the lamp ballast to a test control signal determines the lamp error has occurred by at least one of receiving an error signal provided by the lamp and detecting that the lamp failed to activate.

21. The computer program product of claim 16, wherein the computer executable program code to determine the PWM frequency and duty cycle comprises computer executable program code to read values representative of the PWM frequency and duty cycle from a memory accessible to the microcontroller.

22. The computer program product of claim 16, wherein the display device comprises a rear projection television.

* * * * *

UNITED STATES PATENT AND TRADEMARK OFFICE

CERTIFICATE OF CORRECTION

PATENT NO. : 8,736,541 B2
APPLICATION NO. : 12/037762
DATED : May 27, 2014
INVENTOR(S) : Du et al.

It is certified that error appears in the above-identified patent and that said Letters Patent is hereby corrected as shown below:

Title Page, column 2, ABSTRACT, line 2, delete "used drive" and insert --used to drive--.

Signed and Sealed this
Thirteenth Day of January, 2015

Michelle K. Lee

Michelle K. Lee
*Deputy Director of the United States Patent and Trademark Office*